United States Patent [19]

Vukich

[11] 4,102,613

[45] Jul. 25, 1978

[54] CONCRETE PUMPING MACHINE

[76] Inventor: Martin T. Vukich, 10891 Olinda St., Sun Valley, Calif. 91352

[21] Appl. No.: 757,482

[22] Filed: Jan. 6, 1977

[51] Int. Cl.[2] ..... F04B 7/06; F04B 15/02

[52] U.S. Cl. ..... 417/516; 417/900; 198/616; 198/706

[58] Field of Search ..... 417/900, 516, 517; 198/616, 702, 706; 302/12, 13

[56] References Cited

U.S. PATENT DOCUMENTS

| | | | |
|---|---|---|---|
| 1,376,989 | 5/1921 | Woods | 198/702 X |
| 1,527,747 | 2/1925 | Probst | 198/616 |
| 2,503,832 | 4/1950 | McCline | 198/702 X |
| 3,639,086 | 2/1972 | Robbins | 417/900 UX |
| 3,659,970 | 5/1972 | McElroy | 417/900 X |
| 3,667,865 | 6/1972 | Faldi | 417/900 X |

*Primary Examiner*—Carlton R. Croyle
*Assistant Examiner*—Richard E. Gluck
*Attorney, Agent, or Firm*—Poms, Smith, Lande & Glenny

[57] ABSTRACT

A pump for concrete or other moist flowable material containing aggregate, including a hopper, a pair of alternately stroking pump assemblies below the hopper for forcing concrete via a junction valve into a common output line, and a loading system for alternately charging the two pump assemblies with concrete from the hopper. The loading system includes a conveyor and a pair of generally vertical charging chambers having lower outlet ports communicating with inlet openings in the respective pump assemblies, and upper portions extending into the hopper through the lower hopper wall and terminating upwardly in open tops disposed above the highest possible level of concrete in the hopper. The open top of each charging chamber is sealed by a latchable closure valve during the pumping stroke of its associated pump assembly, and is open during the return stroke to permit concrete, continuously delivered by the conveyor from the hopper, to replenish the charging chamber as the latter in turn fills its pump assembly preparatory to the next pumping stroke. The conveyor includes a vertically oriented disk mounted for continuous driven rotation about a horizontal shaft extending transversely across the upper portion of the hopper. The disk carries a number of angularly spaced scoop buckets on each of its opposite faces, and the buckets in the lower portion of the disk scoop concrete from the hopper. At or near their uppermost travel the buckets dump their contents onto inclined chutes which deliver the concrete to the tops of the charging chambers, thus refilling whichever of the chambers is open at any given time. The buckets may be fixed to the disk or, in an alternate form of the invention, may be pivotally mounted thereon, being permitted limited angular movement during disk rotation.

6 Claims, 10 Drawing Figures

| PUMP STROKE | | MOTOR PISTON POSITIONS | | |
|---|---|---|---|---|
| | | 90 | 110 | 184 |
| 70<br>100 | POWER<br>RETURN | IN | OUT | IN |
| 70<br>100 | RETURN<br>POWER | OUT | IN | OUT |

CONCRETE PUMPING MACHINE

BACKGROUND AND FIELD OF THE INVENTION

The present invention relates generally to pumps, and more particularly to a pump for pumping concrete or other similar moist flowable material containing aggregate, and in which it is important to maintain a substantially constant proportion of mix of component substances in the material delivered by the pump. Pumps of this general type have been proposed in the past, as illustrated by U.S. Pat. No. Re. 26,820 to Bennett, U.S. Pat. No. 3,659,970 to McElroy, and by the prior patents cited therein.

SUMMARY AND OBJECTS OF THE INVENTION

The present invention distinguishes over and improves upon the prior devices in this field, by providing apparatus including means for virtually eliminating the possibility that a solid piece of aggregate might cause the pump to malfunction, as has been true of apparatuses in the past; and to ensure that the prescribed mix of component substances in the material being pumped, such as concrete, is in fact delivered to the output conduit or pipe by the device of the present invention.

More particularly, the pump of the present invention includes a hopper for receiving and holding a quantity of mixed flowable material such as concrete, a pair of alternately stroking pump assemblies below the hopper for forcing concrete via a junction valve into a common output line or conduit, and a loading system for alternately charging the two pump assemblies with concrete from the hopper.

In further detail, the loading system in accordance with the present invention includes a conveyor and a pair of generally vertical charging chambers, each having a lower outlet port in fluid communication with an inlet opening in one of the two pump assemblies. The chambers project upwardly through the lower hopper wall, and terminate upwardly in open tops, preferably circular, which are disposed above the highest possible level of concrete mix in the hopper and thus are never immersed in the mix. Each charging chamber is provided with a closable valve by which to cyclically seal its open top during the pumping or power stroke of its associated pump assembly, and to open that top during the return stroke. The conveyor continuously delivers concrete mix to the tops of both charging chambers, thus maintaining in filled condition the chamber whose top is open, so that chamber in turn, through its lower outlet port, charges concrete mix downwardly into its associated pump assembly during the latter's return stroke. Because the tops of the charging chambers are above the highest level of the concrete mix in the hopper, it is impossible for a solid piece of aggregate, suspended in the mix, to become lodged between the top and the closure valve and thus to prevent complete closure of the valve during the subsequent portion of the operating cycle.

The preferred form of conveyor means in the present invention serves not only to deliver concrete mix to the tops of the charging chambers, but also to continuously agitate the mix in the hopper, thus virtually eliminating stratification of the mix. Thus, the conveyor may include a vertical disk or spider mounted for rotation about a horizontal axis and with its lower portion immersed in the concrete mix in the hopper. The conveyor disk carries thereon a number of angularly spaced buckets or scoops which, during rotation of the disk, pass through the concrete mix in the hopper and are filled with a quantity of that mix and, during a subsequent portion of the cycle of revolution of the disk, the buckets dump their contents in such a position as to replenish the level of mix in whichever one of the charging chambers is open. Each individual bucket or scoop may be fixed to the disk; alternatively, each scoop may be pivotally carried by the disk and permitted limited angular movement by means of a stop member such as a stub carried by the disk adjacent to each of the pivoted scoops. In order to minimize pulsations in the flow of fluid concrete delivered by the present machine, the common output conduit may include conventional accumulator means providing an upper cushion of a compressible material such as air.

It is accordingly the principal object of the invention to disclose and provide a novel pumping apparatus for fluid material including solid ingredients such as aggregate in fluid concrete. Other objects of the invention are to provide, in such an apparatus, a pumping assembly having cyclically alternating pumping and return strokes, and means for cyclically charging the pump assembly during its return stroke; to provide such an apparatus in which the charging means includes a vertically mounted disk or spider rotatable about a horizontal axis and provided with a plurality of bucket scoops thereon for conveying upwardly quantities of concrete mix in a hopper; to provide such a charging means in which each bucket scoop is pivotally carried by the conveyor disk, movement of the parts being so regulated that the contents of a scoop serve to partially replenish a charging chamber during the return stroke of the pump assembly associated with the chamber; to provide such an apparatus wherein each charging chamber includes latchable closure means movable to closed position in timed relation with the occurrence of the pumping stroke of the associated pump assembly; and for other and additional objects and purposes as will be understood from a reading of the following description of illustrative embodiments of the invention, taken in connection with the accompanying drawings.

DETAILED DESCRIPTION

Figure 1:
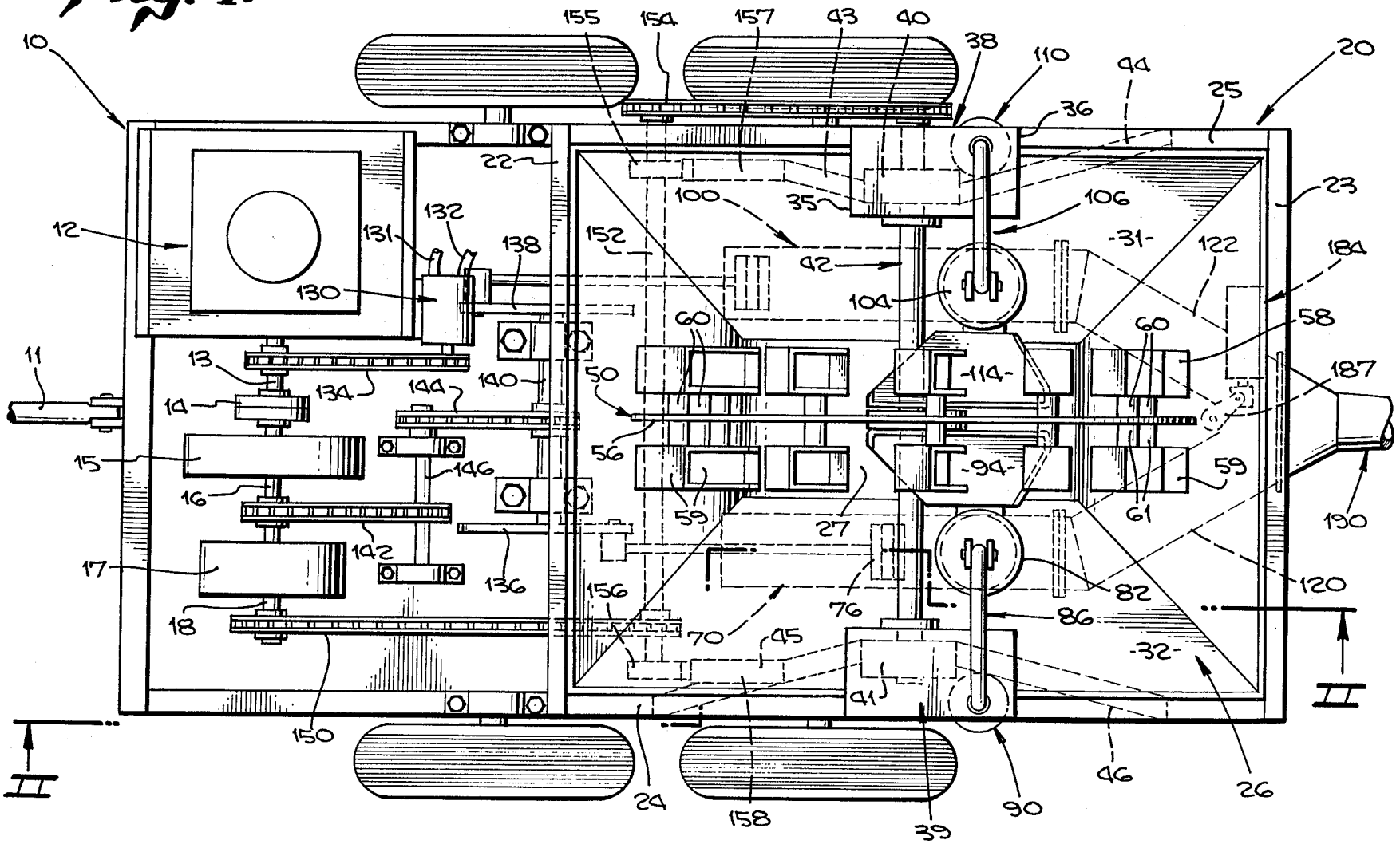
FIG. 1 is a top plan view of a concrete pumping machine embodying the present invention.
Figure 2:
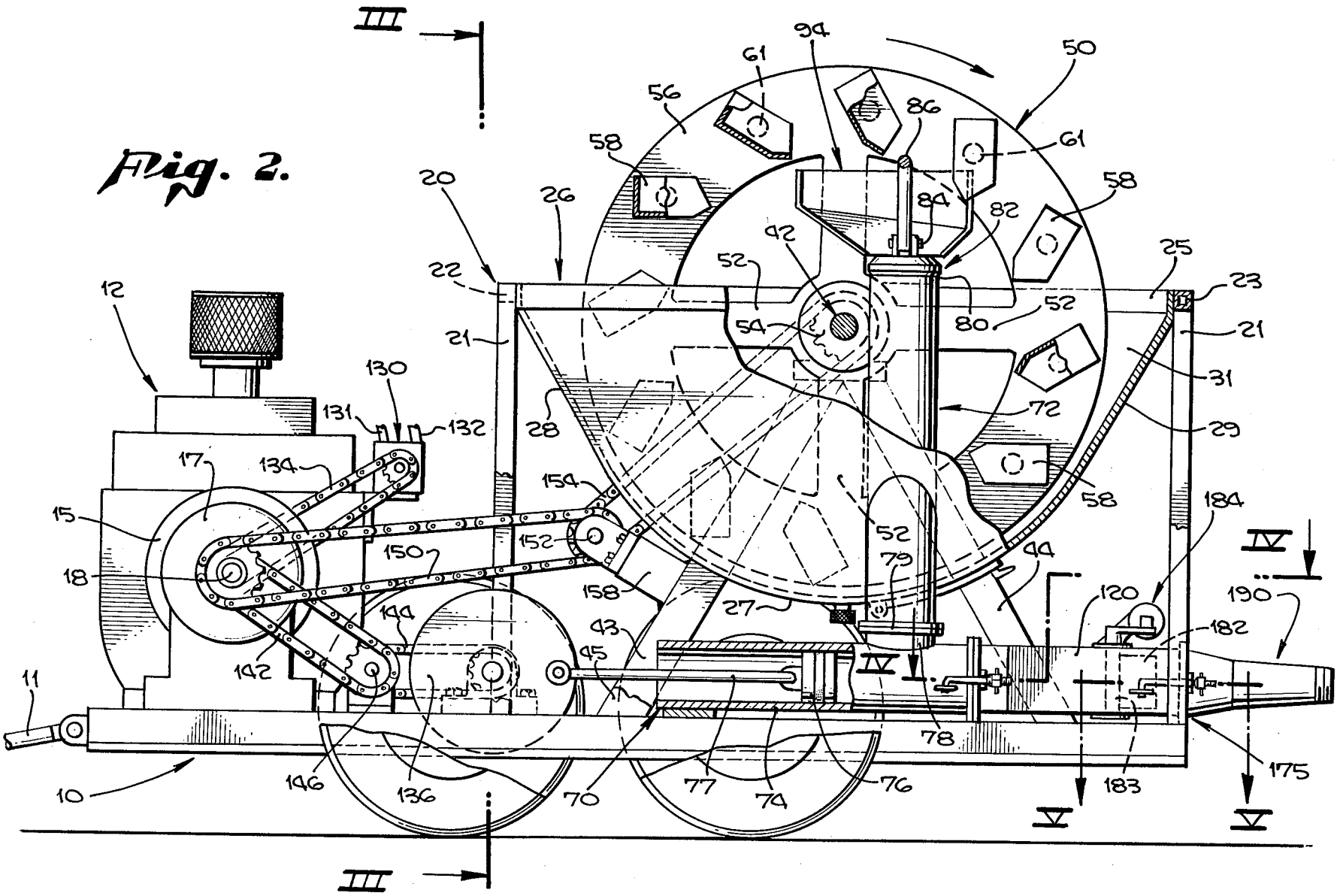
FIG. 2 is a side elevational view, partially in section, taken along the broken line II—II of FIG. 1.

Referring now in detail to the drawings, and first to FIGS. 1 and 2, the concrete pump of the present invention is shown mounted upon a trailer having a rectangular frame indicated generally at 10 and provided with a drawbar 11 for attachment to a towing vehicle not shown. Mounted on the forward end of the trailer is a power source such as an internal combustion engine indicated generally at 12 having an output shaft 13 connected through a coupling 14 to a speed reducer 15 whose output shaft 16 drives a transmission 17 having an output shaft 18. The output shafts of the engine, speed reducer and transmission provide power takeoffs whose detailed functions will be described hereinafter.

Figures 3, 10:
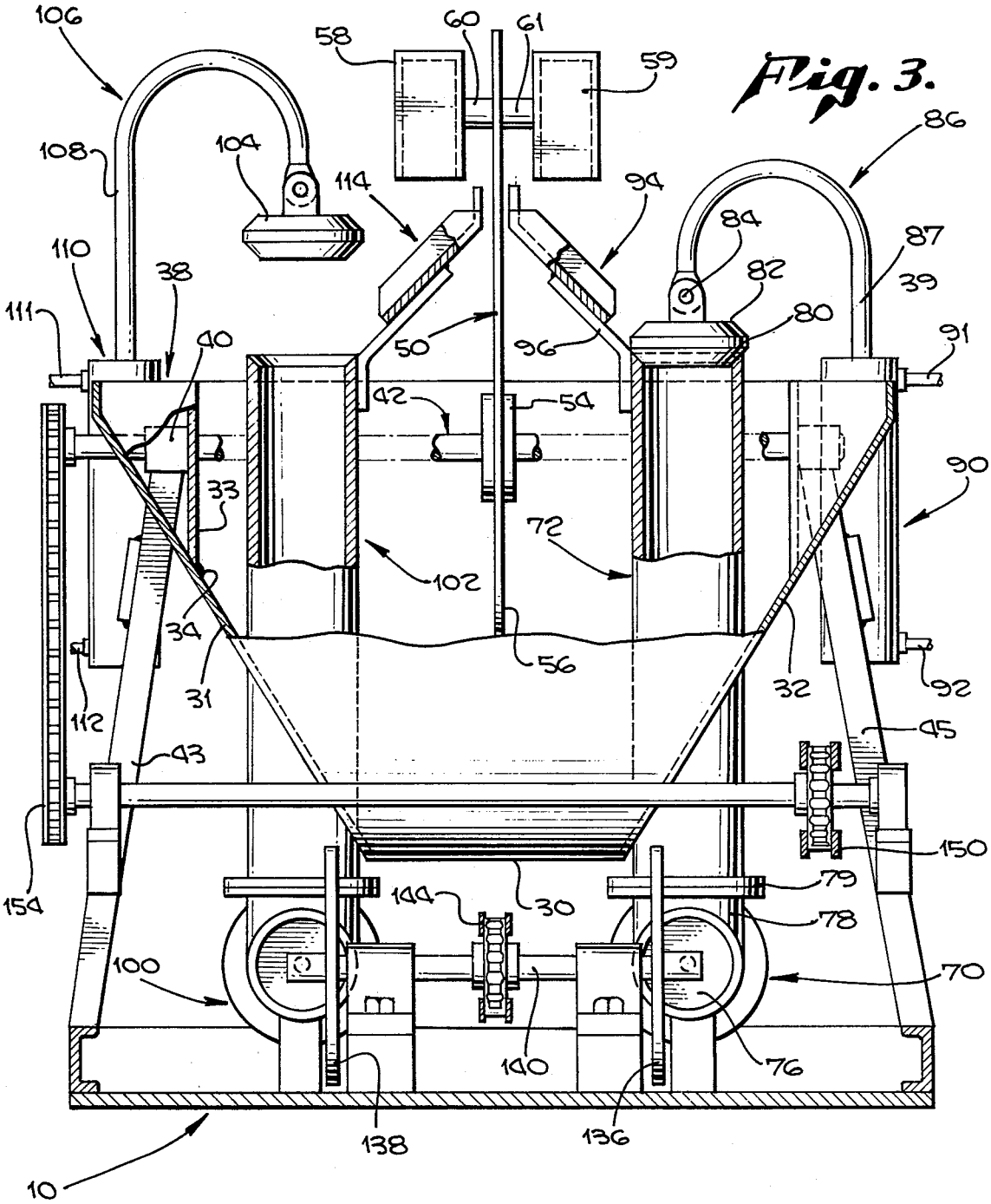
FIG. 3 is an elevational view, partially in section and with portions broken away, taken along the arrows III—III of FIG. 2.
FIG. 10 is a chart showing the positions of the hydraulic motor pistons during each half of the operating cycle of the machine.

As best seen in FIG. 2, the rear portion of the trailer includes a rectangular superstructure indicated generally at 20 having vertical support legs 21, front and rear transverse ties 22, 23, and side rails 24, 25 for supporting a hopper indicated generally at 26. The hopper includes a lower wall having a lowermost circular section 27 and upwardly extending front and rear walls 28 and 29 respectively. Viewed longitudinally, as seen in FIG. 3, hopper 26 includes a transverse flat bottom 30 and, extending divergently upwardly therefrom, sidewalls 31 and 32.

At their upper ends, sidewalls 31 and 32 are provided with means forming a pair of oppositely disposed chambers for housing a pair of support bearings for an upper transverse shaft of the present machine. A vertical plate 33 is fixed as by weld 34 at its lower edge to the inner surface of sidewall 31, and extends upwardly to substantially the same height as the upper rim of the hopper. As best seen in FIG. 1, front and rear walls 35 and 36 extend outwardly from opposite ends of vertical plate 33 and are fixed at their outer edges to sidewall 31, to form a chamber indicated generally at 38. It will be understood that a similar chamber indicated generally at 39 is similarly formed on the opposite side of the machine. Within chambers 38 and 39 there are mounted bearings 40 and 41 respectively for rotatably journaling therein a transverse shaft indicated generally at 42.

Bearing 40 is supported by a pair of angularly related struts 43 and 44, which are fixed at their lower ends to the trailer frame, and bearing 41 is similarly supported on struts 45 and 46. Centrally of its length, shaft 42 has mounted thereon a conveyor disk indicated generally at 50, desirably taking the form of a spider having a plurality of arms 52 extending radially outwardly from a central hub 54, the outer ends of the arms being integrally connected to the annular functional portion of the disk 56. Each face of disk 56 has mounted thereon a plurality of angularly spaced scoop buckets, the buckets on one face of the disk being indicated at 58 and the buckets on the other face of the disk being indicated at 59. Each bucket is supported on the disk by arms 60 and 61 respectively. As will be described in detail hereinafter, rotation of disk 50 in a clockwise direction as seen in FIG. 2 causes each bucket, in the lower portion of its travel, to scoop a quantity of concrete mix from the interior of the hopper and to carry that quantity upwardly so that, in the upper portion of the travel of an individual bucket, its contents are spilled out into, alternately, one or the other of two vertically oriented charging chambers of the machine. Any portion of the contents of a particular bucket which is not received in one of the two charging chambers falls back into the mix in the hopper.

The present machine includes a pair of identical, symmetrically arranged pumping assemblies, each including a horizontally disposed pump proper and a vertically oriented charging chamber. As seen in FIG. 2, the left-hand pumping assembly includes a pump indicated generally at 70 and a charging chamber indicated generally at 72. Pump 70 includes a conventional cylinder 74, in which piston 76 is slidably mounted in conventional fashion. A piston rod 77 is pivotally attached to piston 76 and extends forwardly therefrom, and is actuated by power means to be described later. Rearwardly of the rearmost position of piston 76 seen in FIG. 2, cylinder 74 is provided with an upwardly directed pipe 78 communicating with the interior of cylinder 74 and terminating upwardly in a fitting 79. Connected to fitting 79 and extending upwardly therefrom is charging chamber 72 previously mentioned, which terminates upwardly in an open end defined by an upper edge 80.

Means are provided in accordance with the invention for cyclically sealing the upper open end of charging chamber 72. In the present embodiment of the invention, such means include a closure member or seal 82, pivotally attached at 84 to one end of an arcuate actuating arm indicated generally at 86. The other end of arm 86 includes a longitudinal portion 87, which is the piston rod of a hydraulic motor indicated generally at 90 and having hydraulic hose connections 91 and 92.

Means are provided for guiding concrete mix falling from scoop bucket 59 toward the upper end of charging chamber 72, and in the present illustrative form of the invention such means include a guide chute indicated generally at 94 supported by bracket plate 96 which in turn is fixed to the upper end of charging chamber 72.

As will be seen in the drawings, and particularly FIGS. 1 and 3, the present machine includes a second pumping assembly including pump 100, its associated charging chamber 102, closure member 104, arcuate arm 106, longitudinally extending piston rod 108, hydraulic motor 110 and its hoses 111 and 112, and guide chute 114, all identical to the corresponding parts earlier described.

In the operation of the present machine, pumps 70 and 100 are out of phase with one another, so that the pumping stroke of the piston of one of the pumps takes place during the return stroke of the piston of the other pump. Thus, as the parts are seen in dotted outline in FIG. 1, piston 76 of pump 70 is shown at the end of its pumping stroke, while the piston of pump 100 is at the end of its return stroke. During the pumping stroke of piston 76, closure 82 seals the upper end of charging chamber 72, so that the concrete mix which has previously been fed into pump 70 by charging chamber 72 is forced rearwardly from pump 70 into conduit 120. During the other half of the cycle, pump 100 forces concrete mix within its cylinder rearwardly into conduit 122. As will be described in connection with FIGS. 4 and 5, conduits 120 and 122 merge in a junction provided with valve means which insure that concrete mix pumped by one of the pumps of the present machine does not flow backwardly into the outlet conduit of the other pump of the machine. Instead, the pulsating flow of concrete mix in conduit 120 is merged with the pulsating flow of concrete mix in 122, the pulsations of the two conduits being 180° out of phase, and the combined flow enters the outlet delivery conduit of the machine. The latter delivery conduit, as will be understood, may be connected to hoses or pipes as may be desired for delivery of the concrete mix under pressure to an appropriate location for emplacement or other use.

Pressurized hydraulic fluid for actuating hydraulic motors 90 and 110, as well as a further hydraulic motor yet to be described, is provided by a hydraulic pump indicated generally at 130 having outlet and inlet conduits 131 and 132, the pump being driven by a chain 134 from output shaft 13 of engine 12. The pistons of the working pumps 70 and 100 of the present machine are driven by a pair of crank disks 136 and 138 respectively which are mounted on a shaft 140. The latter shaft is driven by output shaft 16 via chains 142 and 144 and jack shaft 146. The main conveyor disk 50 of the machine is drven by output shaft 18 of transmission 17, via chain 150, transverse shaft 152, and chain 154. Shaft 152 is journalled in bearings 155, 156 carried by bracket arms 157, 158, fixed to struts 43, 45 and projecting forwardly therefrom.

Figure 4:
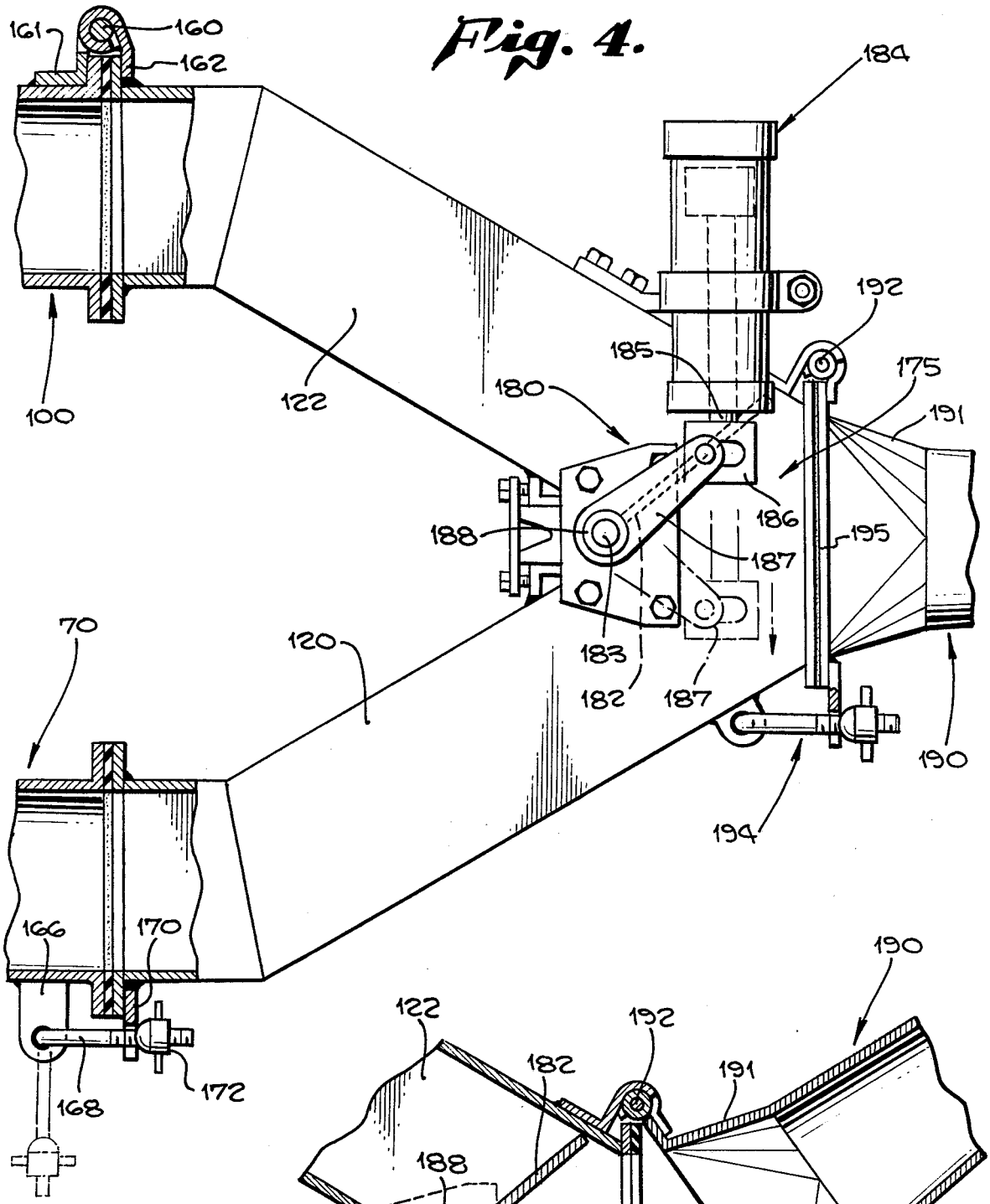
FIG. 4 is a fragmentary top plan view, partially in section, of the Y-junction taken along the broken line IV—IV of FIG. 2.
Figure 5:
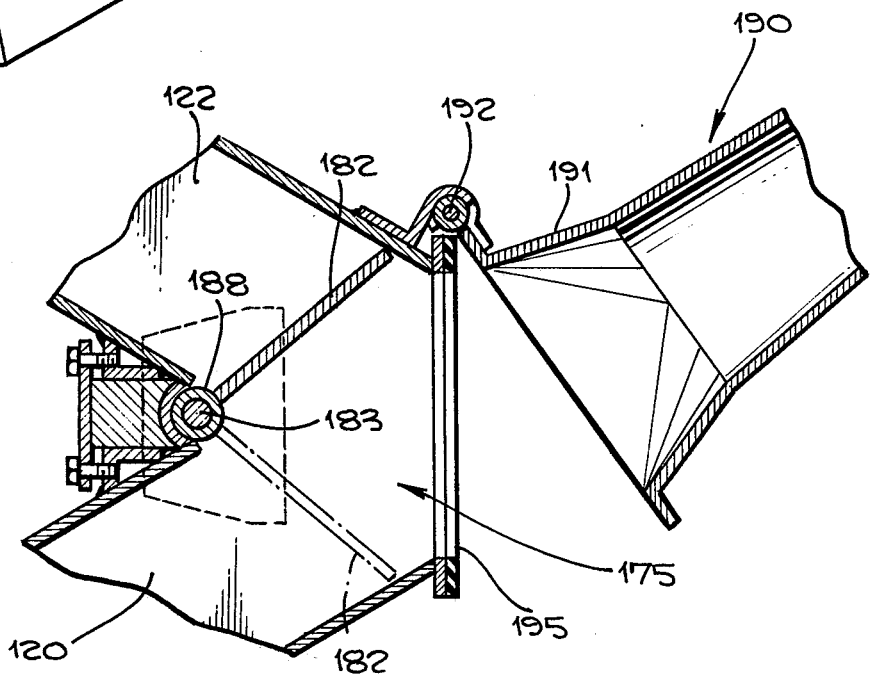
FIG. 5 is a fragmentary sectional view of the Y-junction, taken on the arrows V—V of FIG. 2, but with the outlet conduit swung away from its operative position into a position for cleaning.

The construction of the juncture of conduits 120 and 122, and the associated check valve means, will now be described with reference to FIGS. 4 and 5. Means are provided for pivotally supporting the juncture assembly on the present machine, in order to permit periodic swinging of the conduit juncture to facilitate periodic cleaning of the conduit juncture and of the pumps themselves. Thus, as seen in FIG. 4, a vertically oriented pivot pin 160 is fixedly mounted on a support bracket 161, fixed to the outlet end of pump 100. A hinge sleeve 162 is fixed to outlet conduit 122 and is pivotally carried on bracket 161 for swinging through a horizontal arc about pivot pin 160. The other conduit 120 of the juncture assembly is detachably attached to the outlet end of pump 70, and means are provided for selectively attaching or detaching conduit 120 to that pump. Thus, the outlet end of pump 70 has mounted thereon an outwardly projecting bracket 166, to which is pivotally connected a dog 168 whose shank is receivable in a U-shaped latching bracket 170 against which locking nut 172 may be abutted to lock the parts in their assembled relation as shown.

Conduits 120 and 122, desirably rectangular in section, are joined at their outer ends in a juncture indicated generally at 175, and a valve assembly indicated generally at 180 is mounted on the juncture. As best seen in FIG. 5, the valve assembly includes a closure plate 182 mounted for pivotal rotation about the axis of a vertical pivot pin 183, and swingable between the two positions shown in FIG. 5. In each of its limiting positions, the distal edge of plate 182 abuts the inner surface of the side walls of the outer ends of conduits 120 or 122. In each of those limiting positions, plate 182 prevents concrete mix from entering into one or the other of the conduits, while permitting pressurized concrete mix in either of the conduits to move rightwardly as seen in FIG. 5 into delivery conduit indicated generally at 190.

Means may be provided in accordance with the invention for actuating closure plate 182 into one or the other of its two positions. In the present form of the invention, such means include a hydraulic motor indicated generally at 184 having a piston rod 185 including a slotted block 186 for engaging a pin at the outer end of a crank arm 187, the latter being fixed to an upper extension of sleeve 188 on which closure plate 182 is mounted.

In order to facilitate periodic cleaning and maintenance of juncture 175, delivery conduit 190 may be pivotally attached to juncture 175 for swingable movement about the axis of pin 192, thus corresponding in function to pivot pin 160 previously described; and the parts may be selectively latched in assembled relation by latch means indicated generally at 194, similar in function and construction to dog 168 and its associated parts previously described. In a typical installation, delivery conduit 190 is desirably cylindrical in shape, and there is accordingly provided a throat section 191 for smoothly connecting the rectangular outlet 195 of juncture 175 to the cylindrical contour of delivery conduit 190.

Figure 6:
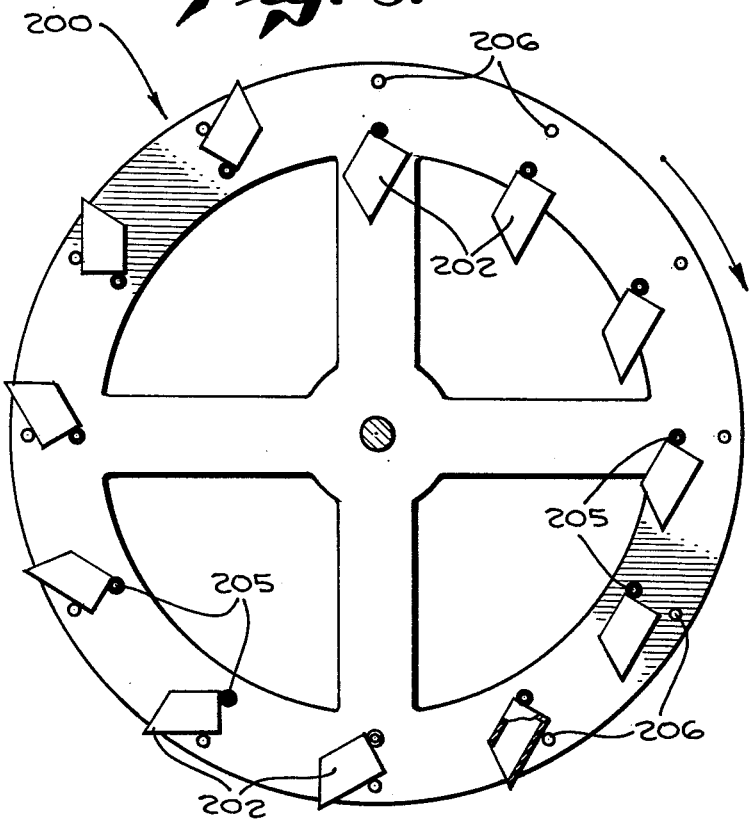
FIG. 6 is a side elevational view of an alternate form of the conveyor, in which the scoop buckets are pivotally mounted on each face of the conveyor disk.
Figure 7:
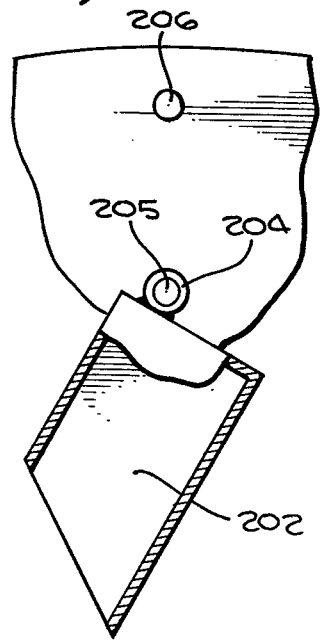
FIG. 7 is a fragmentary view, on an enlarged scale, of the uppermost conveyor bucket in its dumping position.

For some applications, it may be desirable to mount each scoop bucket pivotally on the conveyor disk, rather than the fixed mounting heretofore described in connection with disk 50. Such an arrangement is shown in FIGS. 6 and 7, and includes a conveyor disk indicated generally at 200, similar in construction and function to disk 50 previously described except that each individual scoop bucket is pivotally mounted on one or the other of the vertical faces of conveyor disk 200. More specifically, scoop buckets 202 each have mounted on its solid bottom end a sleeve 204 which is pivotally carried on pivot pin 205, projecting horizontally from the face of disk 200. Associated with each pivot pin 205 and spaced radially outwardly therefrom, is a stop pin 206, also projecting horizontally from the face of the disk. As will be seen from the showing of FIG. 6, and assuming clockwise rotation of conveyor disk 200, the buckets 202 hang downwardly during their movement seen in the right half of FIG. 6 until a particular bucket reaches the approximate lowermost point of its travel. At that point, the bucket abuts stop pin 206 so that further pivotal movement of each bucket around its pivot pin is prevented until the bucket arrives at the upper zone of its travel, where gravity causes the bucket to swing clockwise about its pivot pin, thus dumping its contents onto the guide chute in the manner previously described in connection with FIG. 2.

Figure 8:
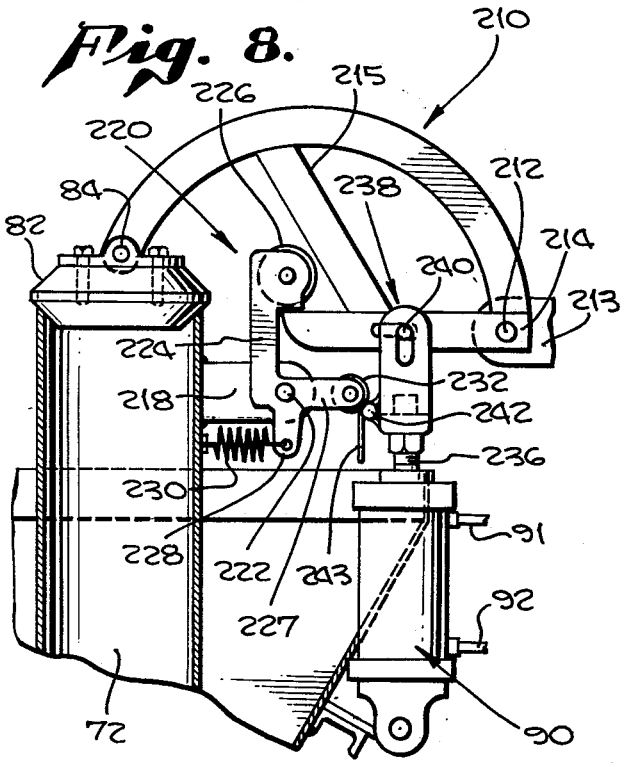
FIGS. 8 and 9 are fragmentary elevational views, partially in section, of an alternative form of closure valve for the right hand charging chamber, showing the valve in closed and opened position respectively.
Figure 9:
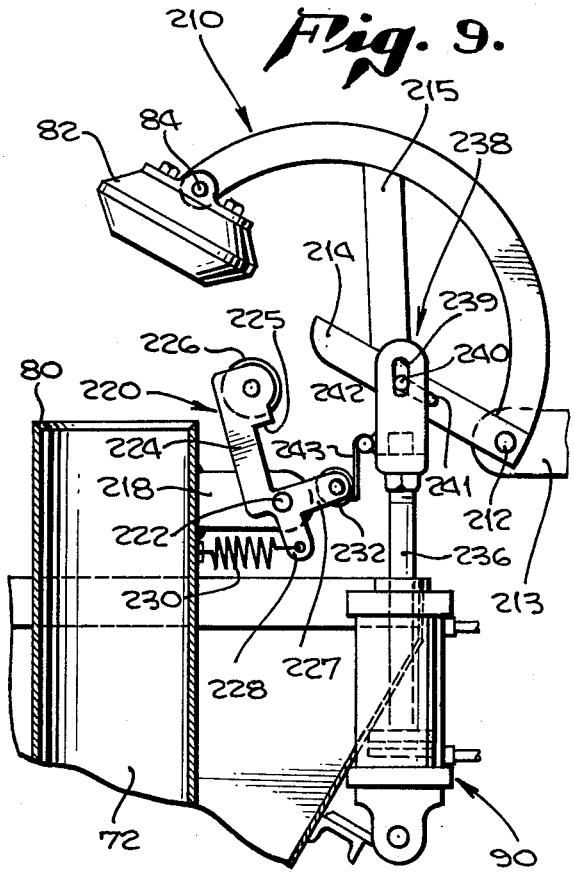

In FIGS. 8 and 9 there is shown an alternative form of selectively sealing closure means for the upper ends of the charging chambers in order to provide a more positive seal in the closed position. Thus, as seen in FIG. 8, closure member 82 sealingly closes the upper end of charging chamber 72, and is pivotally mounted at 84 on the outer end of an arcuate arm indicated generally at 210 which is pivotally mounted for swinging about the axis of pivot pin 212 carried on a bracket 213. Arcuate arm 210 has fixed thereto a horizontally extending arm 214 and, to provide rigidity to the structure, an inclined strut arm 215. The upper portion of charging chamber 72 is provided with an outwardly extending bracket arm 218 on which is pivotally mounted a latch member indicated generally at 220 for pivotal movement about the axis of pivot pin 222. As best seen in the unlatched position of FIG. 9, latch member 220 includes an upwardly extending leg 224, provided with a downwardly directed shoulder 225. The uppermost end of leg 224 may be provided with a roller 226. The lower portion of latch member 220 includes a generally horizontally extending arm 227 and a downwardly extending arm 228, the latter being urged leftwardly by a resilient member such as spring 230. The outer end of arm 227 has mounted thereon a roller 232.

Hydraulic motor 90 includes an upwardly extending piston rod 236 having at its upper end an actuating head indicated generally at 238 provided with a slot 239 which slidably receives a pin 240, the pin also being slidably received in a slot 241 formed in arm 214. Head 238 is also provided with an outwardly projecting member 242 having a lower extending arm 243, these parts together serving as a cam in engagement with roller 232 of arm 227.

In the closed position seen in FIG. 8, shoulder 225 of latch 220 abuts the upper face of the outer end of arm 214, thus positively maintaining closure member 82 in sealing relationship with the upper end of charging chamber 72 despite substantial upward pressure exerted against closure member 82 by the concrete mix within charging chamber 72. When the operating cycle of the present machine requires that the upper end of charging chamber 72 be opened, hydraulic motor 90 is actuated so that its piston rod 236 moves upwardly. During the initial upward movement of head 238, the camming members 242 and 243 attached to head 238 bear against roller 232 of arm 227, thus raising that roller and arm into their positions seen in FIG. 9, and member 243 maintains the latch member 220 in its FIG. 9 position during further upward movement of piston rod 236 and its head 238. As will be evident, that further upward movement of the piston rod, transmitted via pin 240 to arm 214, causes the arcuate arm 210, and closure member carried thereon, to move to their fully opened positions seen in FIG. 9. It will also be evident that, when hydraulic motor 90 is energized to withdraw piston rod 236 downwardly, the moving parts will return to the closed position seen in FIG. 8, the last movement being the clockwise movement of latch 220 under the biasing force of spring 230.

FIG. 10 summarizes in chart form the cycle of operation of the present machine, showing piston positions of each of the three hydraulic motors during the power and return strokes of the two pumps 70 and 100. Thus, referring to the parts as seen in FIGS. 1–3, pump 70 has just reached the end of its power stroke, during which the piston of hydraulic motor 90 has been in its IN position, retaining closure 82 in its sealing relation with the upper end of charging chamber 72. By the same token, the piston of motor 110 is in its OUT position seen in FIG. 3, holding closure 104 in its uppermost position so that the dumped contents of buckets 58 of conveyor disk 50 maintain the opened charging chamber 102 completely filled during the concurrent return stroke of pump 100. Also, referring to FIGS. 4 and 5, the piston of motor 184 is in its IN position, corresponding to the position of plate 182 seen in solid lines in FIG. 5. During the other half cycle, of course, the motor pistons are in their respective opposite positions while pump 100 is in its power stroke and pump 70 is in its return stroke.

Modificications and changes from the exemplary forms of the invention hereinabove described and illustrated not departing from the spirit of the invention are intended to be embraced within the scope of the following claims.

I claim:

1. A machine for pumping flowable material comprising:

a hopper containing a supply of flowable material, means forming a charging chamber extending vertically in the hopper and having an upper inlet and a lower outlet, the upper inlet projecting above the maximum level of material in the hopper;

a pump including a pumping chamber having an outlet end and a piston in the pumping chamber cyclically movable toward and away from the outlet end, the pumping chamber being provided with an inlet charging port communicating with the charging chamber lower outlet and with the pumping chamber outlet end;

conveyor means for moving flowable material from the hopper to a discharge station above the upper inlet of the charging chamber;

and closure means for closing said upper inlet during piston movement toward said outlet end.

2. The invention as defined in claim 1 including a second charging chamber forming means, a second pump, and a second closure means, each identical to the first named chamber forming means, pump and closure means, there being a second discharge station above the upper inlet of the second charging chamber forming means receiving flowable material from said conveyor means;

juncture means receiving pumped flowable material from the outlet ends of the two pumping chambers, including valve means for preventing movement of flowable material in a direction opposite to the direction pumped;

and power means for driving the pistons in alternating phase relation.

3. The invention as defined in claim 1 including selectively releasable latch means for maintaining the closure means in closed position.

4. The invention as defined in claim 2 wherein said conveyor means comprises a vertically oriented disk, rotatably mounted about a horizontal axis extending across the hopper and a plurality of angularly spaced scoop buckets carried by the disk and submerged in the flowable material during the lower portion of their travel when the disk is rotating.

5. The invention as defined in claim 4 wherein the scoop buckets are arranged in two sets, one set on each face of the disk.

6. The invention as defined in claim 5 wherein the scoop buckets are pivotally mounted to the disk for rotation about horizontal axes, and including stop means for limiting pivotal bucket movement through predetermined arcs about their axes.

* * * * *